US005628557A

United States Patent [19]

Huang

[11] Patent Number: 5,628,557

[45] Date of Patent: May 13, 1997

[54] ASSEMBLY TUBE LIGHT FOR WINDOW DISPLAY

[75] Inventor: Peter K. L. Huang, Taipei, Taiwan

[73] Assignee: Shining Blick Enterprises Co., Ltd., Taipei, Taiwan

[21] Appl. No.: 491,591

[22] Filed: Jun. 16, 1995

[51] Int. Cl.[6] ..... F21P 1/02; F21V 21/00

[52] U.S. Cl. ..... 362/252; 362/152; 362/125; 362/219; 362/249

[58] Field of Search ..... 362/125, 219, 362/225, 145, 152, 226, 249, 252, 151, 806, 457, 488, 147; 439/507, 510, 226, 206

[56] References Cited

U.S. PATENT DOCUMENTS

| | | | |
|---|---|---|---|
| 2,652,483 | 9/1953 | Laidig et al. | 362/249 |
| 4,357,653 | 11/1982 | Kovacs | 362/152 |
| 4,726,781 | 2/1988 | Bernhart et al. | 362/219 |
| 5,161,882 | 11/1992 | Garrett | 362/249 |
| 5,311,414 | 5/1994 | Branham, Sr. | 362/249 |

*Primary Examiner*—Denise L. Gromada
*Assistant Examiner*—Thomas M. Sember
*Attorney, Agent, or Firm*—Bacon & Thomas

[57] ABSTRACT

An assembly tube light including at least two tube lights and at least one connector for connecting each two tube lights either in line or at right angles, each tube light having a first conductor, a second conductor, a plurality of bulbs respectively connected between the first conductor and the second conductor, and two coupling units at two opposite ends, each coupling unit including two diagonal pairs of plug holes arranged in a square and respectively connected to the first conductor and the second conductor, each connector having two pairs of parallel contact pins arranged in a square corresponding to the plug holes of each coupling unit for inserting into two plug hole on a first tube light and two plug hole on a second tube light for permitting them to be fastened together and electrically connected in series, the two contact pins of the same pair being electrically connected together.

1 Claim, 4 Drawing Sheets

ASSEMBLY TUBE LIGHT FOR WINDOW DISPLAY

BACKGROUND OF THE INVENTION

The present invention relates to assembly tube lights, and relates more particularly to such an assembly tube light which permits the tube tubes to be connected either in line or at right angles.

Neon tubes are commonly used in advertising signs for producing variable lighting effects. Although neon tubes can be bent into curved shapes, they cannot be bent into a right angle. Therefore, neon tubes cannot perfectly arranged along the right angles in the four corners of a show window. Furthermore, when a neon tube assembly is made, it is inconvenient to carry and cannot be freely adjusted to change the length.

SUMMARY OF THE INVENTION

It is one object of the present invention to provide an assembly tube light for window display which permits a plurality of tube lights to be connected either in line or at right angles. It is another object of the present invention to provide an assembly tube light for window display which can be conveniently adjusted to the desired length. According to the present invention, an assembly tube light comprises a plurality of tube lights and a plurality of connectors for connecting each two tube lights either in line or at right angles. Each tube light has a first conductor, a second conductor, a plurality of bulbs respectively connected between the first conductor and the second conductor, and two coupling units at two opposite ends for mounting the connectors. Each coupling unit comprises two diagonal pairs of plug holes arranged in a square and respectively connected to the first conductor and the second conductor. Each connector has two pairs of parallel contact pins arranged in a square corresponding to the plug holes of each coupling unit for inserting into two plug hole on a first tube light and two plug hole on a second tube light for permitting them to be fastened together and electrically connected in series. Each two contact pins of the same pair on each connector are electrically connected together.

DETAILED DESCRIPTION OF THE PREFERRED EMBODIMENT

Figure 1:
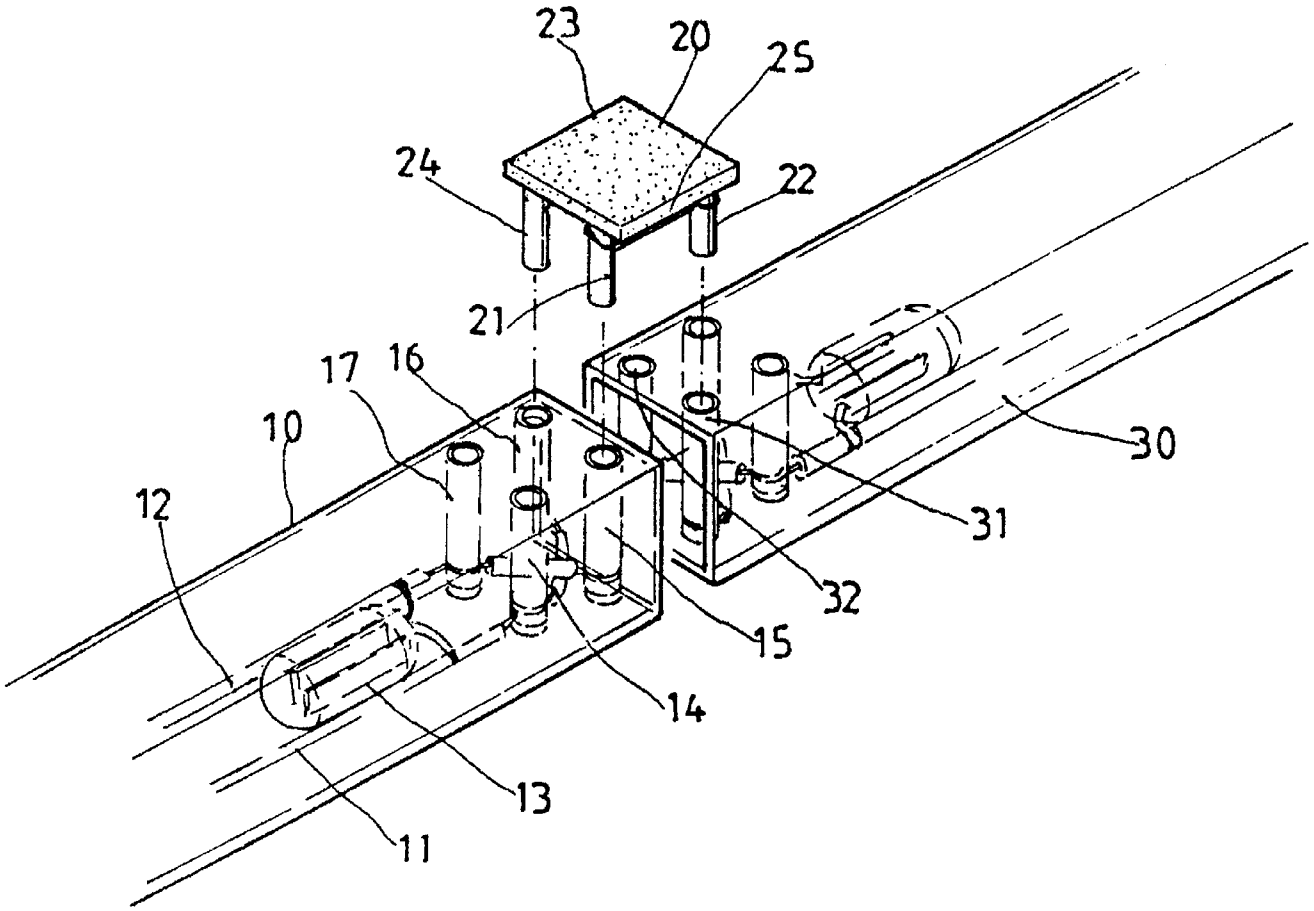
FIG. 1 is an exploded view of an assembly tube light according to the present invention.

Referring to FIG. 1, an assembly tube light for window display in accordance with the present invention comprises a plurality of tube lights 10 and 30 connected with one another in series by connectors 20. The tube light 10 comprises two conductors 11 and 12 longitudinally disposed on the inside, a plurality of bulbs 13 connected in series to the conductors 11 and 12, four plug holes 14, 15, 16, and 17 at each end thereof. The plug holes 14, 15, 16, and 17 are arranged in a square. The conductor 11 is connected to the plug hole 14 and then to the plug hole 16. The conductor 12 is connected to the plug hole 15 and then to the plug hole 17. The connector 20 is made of rectangular shape having two pairs of contact pins 21, 22, 23, and 24 for inserting into the plug holes 14, 15, 16, and 17 at one end of the tube light 10. The first pair of contact pins 21 and 22 are connected by a conductor 25. The second pair of contact pins 23 and 24 are connected by a conductor 26 (see FIG. 3).

Figure 3:
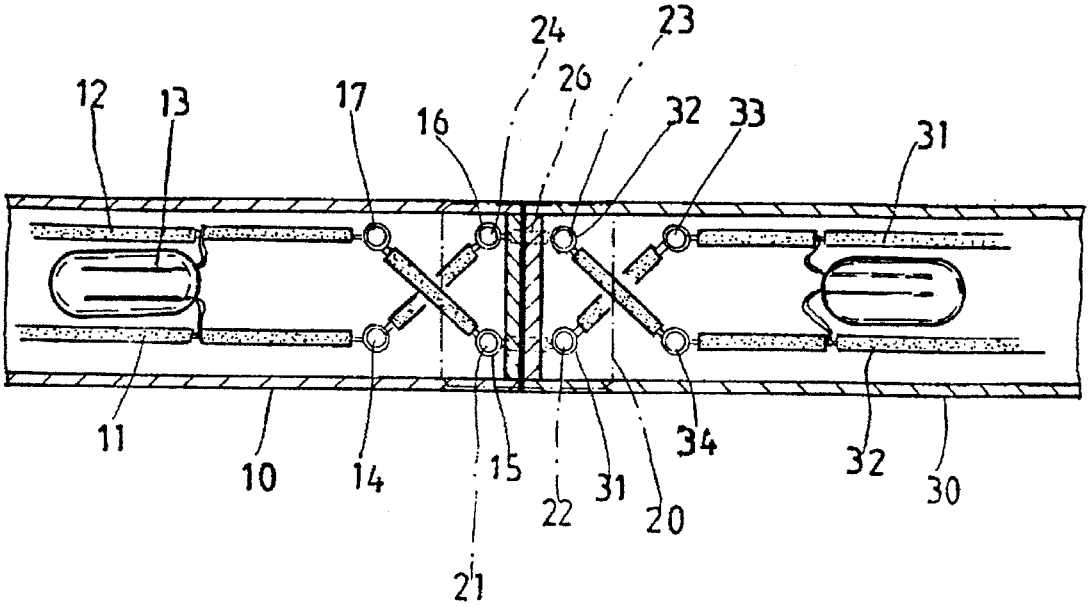
FIG. 3 is a sectional view showing two tube lights connected in line according to the present invention.

Referring to FIG. 3 and FIG. 1 again, when to connect two tube lights 10 and 30 in line, the four contact pins 21, 22, 23, and 24 of the connector 20 are respectively inserted into two plug holes 15 and 16 on the first tube light 10 and the two outer plug holes 31 and 32 on the second tube light 30. Therefore, the conductor 11 is connected to the plug hole 14 then to the plug hole 16, then connected through the contact pin 24 and the conductor 26 and the contact pin 23 to the plug hole 32 on the second tube light 30 and then connected through the plug hole 34 to the conductor 31; the conductor 12 is connected to the plug hole 17 then to the plug hole 15, then connected through the contact pin 21 and the conductor 25 and the contact pin 22 to the plug hole 31 on the second tube light 30 and then connected through the plug hole 33 to the conductor 32.

Figure 2:
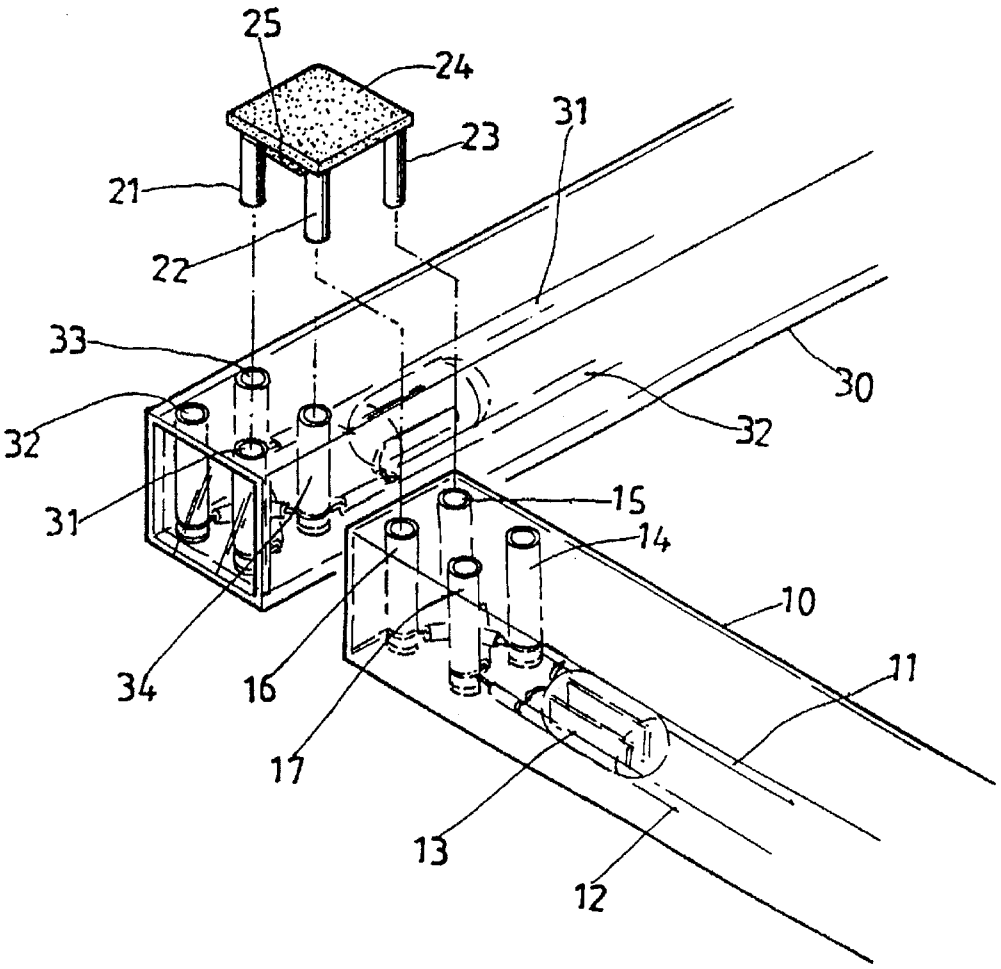
FIG. 2 is similar to FIG. 1 but showing the tube lights arranged at right angles.
Figure 4:
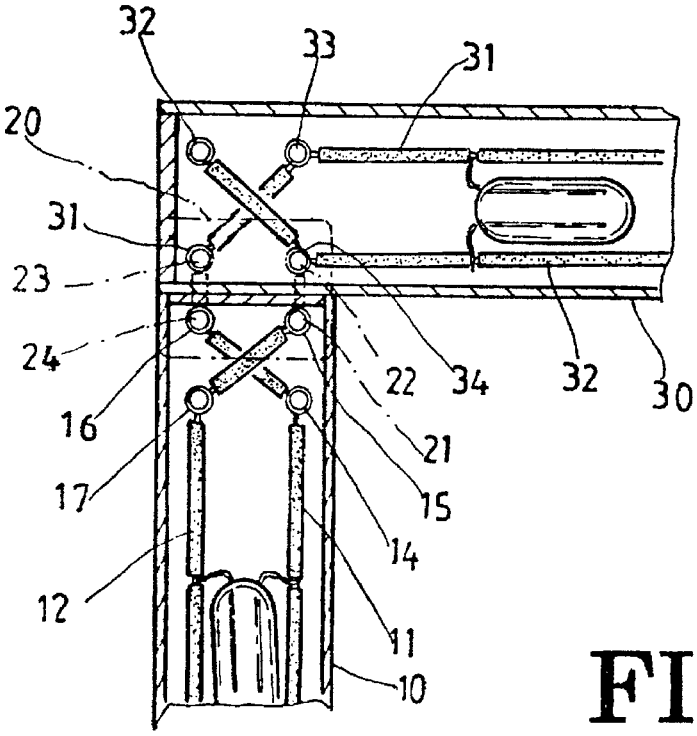
FIG. 4 is a sectional view showing two tube lights connected at right angles according to the present invention.

Referring to FIGS. 2 and 4, when to connect two tube lights 10 and 30 at right angles, the contact pins 21 and 24 are respectively inserted into two plug holes 31 and 34 on the second tube light 30, the contact pins 22 and 23 are respectively inserted into two plug holes 16 and 15 on the first tube light 10. Therefore, the conductor 11 is connected to the plug hole 14 then to the plug hole 16, then connected through the contact pin 22 and the conductor 25 and the contact pin 21 to the plug hole 31 on the second tube light 30 and then connected through the plug hole 33 to the conductor 31; the conductor 12 is connected to the plug hole 17 then to the plug hole 15, then connected through the contact pin 23 and the conductor 26 and the contact pin 24 to the plug hole 34 on the second tube light 30 and then connected to the conductor 32.

Figure 5:
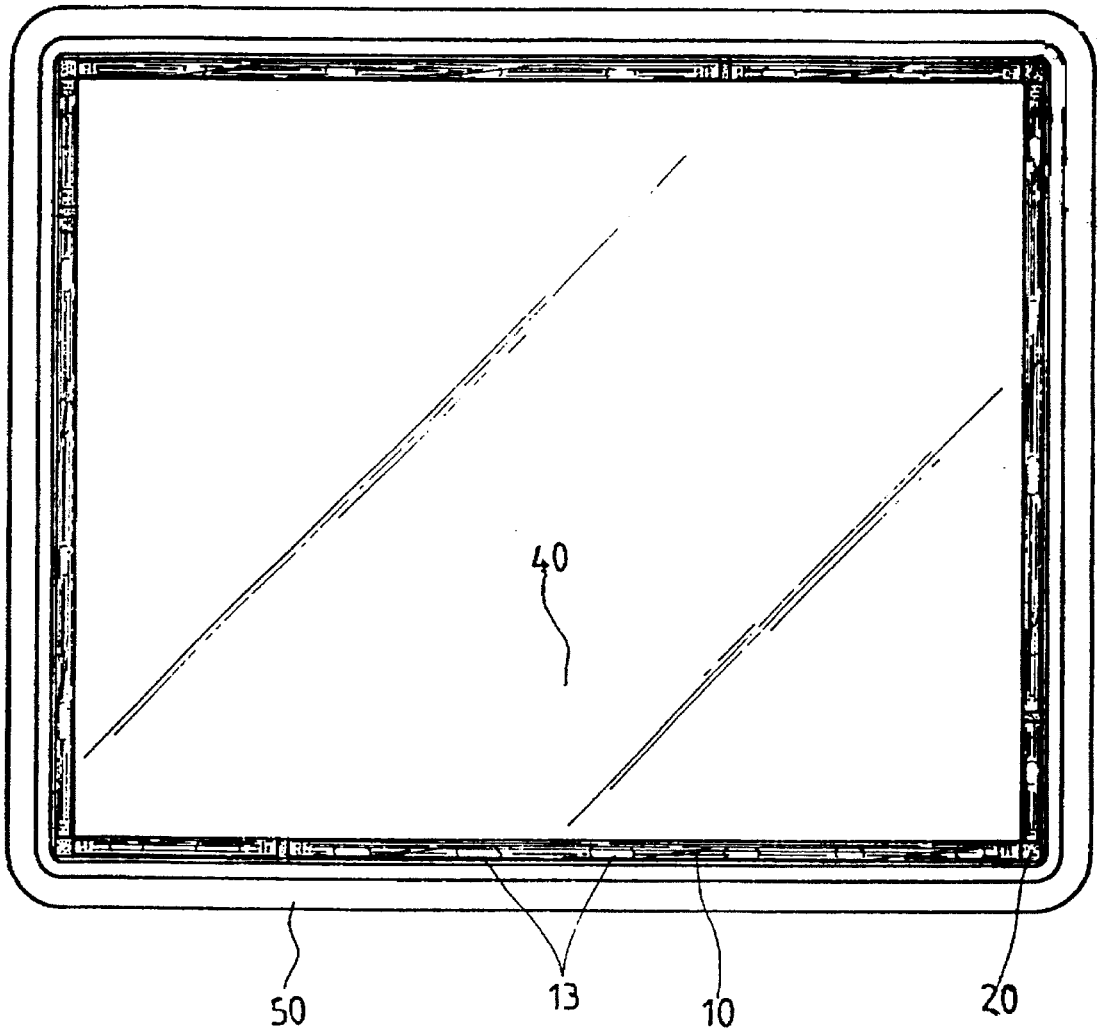
FIG. 5 is an applied view showing an assembly tube light arranged along the four sides of a show window.

Referring to FIG. 5, a plurality of the tube lights 10 are connected in series by connectors 20 and arranged along the packing strips 50 at the four sides of a show window 40.

As indicated, the present invention provides an assembly tube light which permits a plurality of tube lights to be connected either in line or at right angles.

I claim:

1. An assembly tube light comprising at least two tube lights and at least one connector for connecting a first and second tube light, each said first and second tube light comprising a first conductor, a second conductor, a plurality of bulbs respectively connected between said first conductor and said second conductor, and two coupling units at two opposite ends of each said tube light, each coupling unit comprising two diagonal pairs of plug holes arranged in a square and respectively connected to said first conductor and said second conductor, each said connector comprising two pairs of parallel contact pins arranged in a square corresponding to the plug holes of each coupling unit for inserting into two of said plug holes on said first tube light and two of said plug holes on said second tube light for permitting them to be fastened together and electrically connected in series, two of said contact pins of a same pair being electrically connected together.

* * * * *